US007523793B2

(12) United States Patent
Comacchio et al.

(10) Patent No.: US 7,523,793 B2
(45) Date of Patent: Apr. 28, 2009

(54) DRILLING HEAD WITH PROTECTIVE SCREEN

(75) Inventors: Pasqualino Comacchio, Riese Pio X (IT); Patrizio Comacchio, Riese Pio X (IT); Renzo Comacchio, Riese Pio X (IT)

(73) Assignee: Comacchio S.R.L., Riese Pio X (IT)

( * ) Notice: Subject to any disclaimer, the term of this patent is extended or adjusted under 35 U.S.C. 154(b) by 0 days.

(21) Appl. No.: 10/598,787

(22) PCT Filed: Mar. 4, 2005

(86) PCT No.: PCT/IT2005/000120

§ 371 (c)(1),
(2), (4) Date: Sep. 12, 2006

(87) PCT Pub. No.: WO2005/090738

PCT Pub. Date: Sep. 29, 2005

(65) Prior Publication Data

US 2007/0181344 A1 Aug. 9, 2007

(30) Foreign Application Priority Data

Mar. 19, 2004 (IT) ..... PD20040027 U

(51) Int. Cl.
*E21B 21/01* (2006.01)

(52) U.S. Cl. ..... 175/211; 175/219

(58) Field of Classification Search ..... 175/84, 175/88, 207, 208, 209, 211, 162; 166/219, 166/314

See application file for complete search history.

(56) References Cited

U.S. PATENT DOCUMENTS

| | | | | |
|---|---|---|---|---|
| 3,788,423 | A * | 1/1974 | Nittinger et al. | 181/200 |
| 3,997,009 | A | 12/1976 | Fox et al. | |
| 4,321,975 | A * | 3/1982 | Dyer | 175/206 |
| 4,495,073 | A | 1/1985 | Beimgraben | |
| 5,379,852 | A | 1/1995 | Strange, Jr. et al. | |
| 6,598,685 | B1 | 7/2003 | Mashburn | |
| 2003/0213507 | A1 * | 11/2003 | Martin et al. | 134/34 |

* cited by examiner

*Primary Examiner*—David J. Bagnell
*Assistant Examiner*—David Andrews
(74) *Attorney, Agent, or Firm*—Themis Law

(57) ABSTRACT

A drill head for drilling machines having a protective screen for conveying the drilling slurry discharged from the drivers drill rods and related sleeves. A screen constructed according to the principles of the present invention reduces the slurry fallout area in the vicinity of the drilling zone. The screen panel has a generically U-shaped cross section, or in any case such a cross section as to cover wholly or partly at least three sides around the area where the slurry is discharged from the drivers of the drill rod (A) and related sleeve. In one embodiment, the screen panel is coupled to the structure of the drill head by connection supports and translation devices, so to translate the screen panel parallel to the rod and the sleeve.

10 Claims, 1 Drawing Sheet

DRILLING HEAD WITH PROTECTIVE SCREEN

FIELD OF THE INVENTION

The present invention relates to earth drilling machines having an extraction of the drilled material through an outer sleeve by injecting a pressurized air/water flow. More particularly, the present invention relates to the discharge of the drilled material and of the extraction air/water during operation of an earth drilling machine.

BACKGROUND OF THE INVENTION

Drilling machines are known and are structured to obtain vertical or horizontal holes in the ground.

Said machines are provided with a drill head which is coupled to a driver under the head and which drives the drill rod and an outer tube (sometimes called sleeve) surrounding the drill head.

The drill rod is rotated by a motor and is pushed downwards by a translation mechanism called head carriage.

More particularly, the drill rod is typically hollow and allows the passage of air and/or water pumped under pressure inside said rod, thus obtaining a removal of the ground drilled. As a result of the pressure received from the compressor or a water pump, the air/water and the soil drilled rise to the ground surface by traveling between said drill rod and said sleeve and are then discharged from an upper aperture between the inner driver and the outer driver.

The upper aperture of the sleeve coupled to the driver, from which the drilling air/water is discharged together with the soil drilled, is located near the rotating head, which moves down along a slide by means of a head carriage.

During drilling the head, and therefore the drivers, are disposed above the ground.

The air/water under pressure and the soil drilled are discharged from the upper aperture, between the inner driver and the outer driver, spraying the resulting slurry around, flooding and dirtying machinery situated nearby and the surrounding area (which is a nuisance if drilling takes place near boundaries or other constructions), soaking and dirtying persons in areas near the drilling machine.

SUMMARY OF THE INVENTION

In order to overcome the above-mentioned drawbacks, a new drill head provided with a protective screen has been designed and constructed.

It is an aim of the new drill head with protective screen is to contain the jet of air/water and drilled soil.

It is another aim of the new drill head with protective screen to convey the jet of water and drilled soil in a pre-set direction or area.

It is a further aim of the new drill head with protective screen to prevent, or in any case considerably limit, dispersion of the air/water and drilled soil in the area surrounding the drilling machine.

It is still another aim of the new drill head with protective screen to prevent accidents to persons caused by the spreading of the air/water and drilled soil in areas surrounding the drilling machine.

These and other aims, direct and complementary, are achieved by the a drill head constructed according to the principles of the present invention and provided with a protective screen, which includes at least two connection and adjustment supports and a screen panel.

The connection and adjustment supports are applied to the drill head motor, while the screen panel is applied and connected to said supports.

The connection between panel and supports is such to permit the adjustment of the position of said panel on said supports, both laterally, moving it away from or near to the drill rod, and parallel to the drill rod, thus covering or exposing the area of the driver apertures.

Said panel of the new screen conveys the water and the soil that are drilled and discharged between the inner driver and the outer driver to a circumscribed or in any case controlled area.

During drilling the screen is lowered to the height of the driver apertures, while for maintenance the screen is raised with respect to the apertures of said drivers.

Appropriate mechanical-electrical-hydraulic devices provide for the translation of the screen parallel to the drill rod.

The characteristics of the new drill head with protective screen will be illustrated in greater detail in the following description, making reference to the drawings attached as a non-limiting example.

DETAILED DESCRIPTION OF THE INVENTION

Briefly, the rotating shaft (B), housed in and fixed to the drill head, is screw-connected to the inner driver (T1) of the drill rod (A). The inner driver (T1) is connected to the outer driver (T2) of the drill sleeve (C).

The protective screen comprises at least two connection supports (P), which can be applied to the drill head, and a screen panel (S).

Each of said connection supports (P) is provided with at least one pneumatic-hydraulic piston or other translation device (Pa) for application, fixing and adjustment of the screen panel (S).

Said translation device (Pa) is positioned parallel to the axis of the shaft (B), or parallel to the drill rod (A) and to the sleeve (C).

The screen panel (S) basically consists of a generically U-shaped metal sheet (S1), in one single element or several elements, or in any case bent and shaped in order to cover and envelop the drivers (T1, T2) and the rotation shaft (B) on three sides. The inner part of the metal sheet (S1) is provided with connection elements (Sa) for application, connection and adjustment to the translation devices (Pa) of the connection supports (P).

The screen panel (S) is applied to said translation devices (Pa) of said connection supports (P) in order to envelop and cover the shaft (B) and the drivers (T1, T2) on at least three sides.

Figure 2:
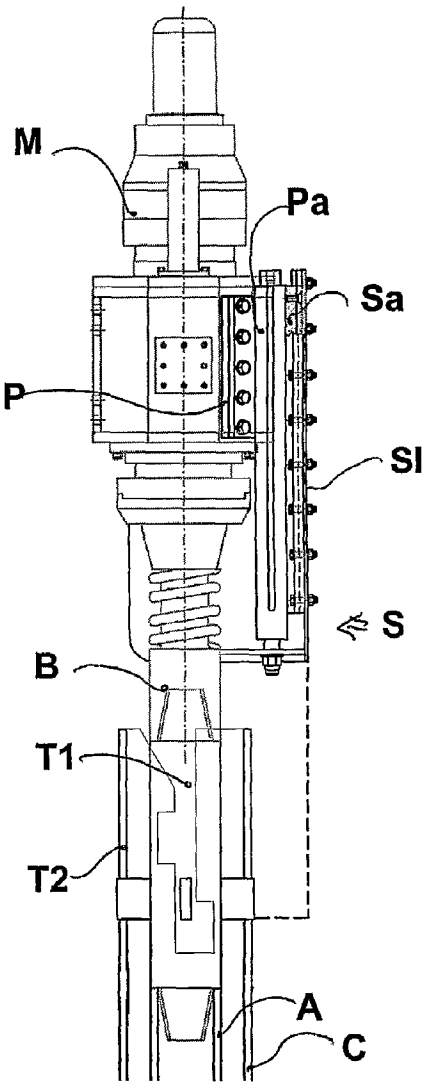
FIG. 2 is a front elevational view of a protective screen according to an embodiment of the invention applied to the drill head.
Figure 1:
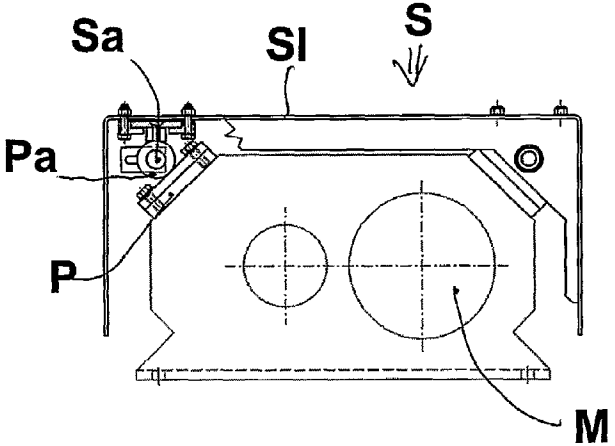
FIG. 1 is a top view of the head including the motor of the drill rod, with plates and a screen panel applied to the drill head.

During connection and disconnection of the head to/from the drill rod (A) and the sleeve (C), the translation devices (Pa) of the protective screen keep the screen panel (S) raised (position shown in FIG. 2) for easy access to the parts to be connected. Throughout the drilling operation, said translation devices (Pa) move the screen panel (S) downwards or towards the drill tip (FIG. 2, position shown by a broken line), thus aligning it with and covering the gap between drill rod (A) and the sleeve (C) where the air/water and drilled soil are discharged.

The water and drilled soil that are discharged from the sleeve (C) encounter the screen panel (S) which retains them and conveys them to the base of the drill rod or towards a pre-set point/direction.

The connection devices (Sa) of the screen panel (S) permit adjustment of the position and angle-direction of said screen panel (S) according to the specific position of the drill rod and the items present in the area around the drilling site.

Therefore, with reference to the preceding description and the attached drawings, the following claims are expressed.

The invention claimed is:

1. A drill head for a drilling machine comprising:

a structure comprising a shaft, a drill rod coupled to an inner driver, and a drill sleeve essentially parallel to the drill rod and coupled to an outer driver; and a protective screen panel supported by the structure when the drilling machine is in operation and also when the drilling machine is not in operation, wherein the protective screen panel is structured to be actuated from a first position substantially exposing the inner and the outer drivers and at least a portion of the shaft when the drilling machine is not in operation, to a second position encircling an aperture between the drill rod and the drill sleeve when the drilling machine is in operation, a slurry being discharged from the aperture.

2. The drill head of claim 1, wherein the protective screen panel has an essentially U-shaped profile, and wherein the protective screen panel is made of one or more pieces.

3. The drill head of claim 1, wherein the protective screen panel is coupled to the structure by coupling one or more plates connected to the protective screen panel to one or more plates connected to the structure.

4. The drill head of claim 3, wherein the one or more connection elements or the one or more connection support are configured to enable a lateral adjustment of the position of the protective screen panel in relation to the structure.

5. The drill head of claim 1, wherein the drilling machine comprises a motor, and wherein the protective screen panel is structured to be actuated by a piston system.

6. The drill head of claim 1, wherein the protective screen panel is movable sideways from the first position to the second position.

7. The drill head of claim 1, wherein the protective screen panel is movable from the first position to the second position is a direction essentially parallel to a longitudinal axis of the drill rod and of the drill sleeve.

8. The drill head of claim 1, wherein the protective screen panel is adjustable to direct an outflow of slurry in different directions during the operation of the drilling machine.

9. The drill head of claim 1, wherein the protective screen panel is movable by a pneumatic or hydraulic piston.

10. A drill head for a drilling machine comprising:

a structure comprising a shaft, a drill rod coupled to an inner driver, and a drill sleeve essentially parallel to the drill rod and coupled to an outer driver; and a protective screen panel supported by the structure when the drilling machine is in operation and when the drilling machine is not in operation, the protective screen having an essentially U-shaped profile made of one or more pieces, wherein the protective screen panel is structured to be actuated by a piston system from a first position substantially exposing the inner and the outer drivers and at least a portion of the shaft when the drilling machine is not in operation, to a second position encircling an aperture between the drill rod and the drill sleeve when the drilling machine is in operation, a slurry being discharged from the aperture, wherein the protective screen panel is coupled to the structure by coupling one or more plates connected to the protective screen panel to one or more plates connected to the structure, and wherein the protective screen panel is adjustable to direct an outflow of slurry in different directions during the operation of the drilling machine.

* * * * *